United States Patent [19]

Pape

[11] 4,272,229

[45] Jun. 9, 1981

[54] PIVOTAL PISTON MACHINE

[75] Inventor: Wilhelm Pape, Wunstorf, Fed. Rep. of Germany

[73] Assignee: WABCO Westinghouse GmbH, Hanover, Fed. Rep. of Germany

[21] Appl. No.: 965,203

[22] Filed: Nov. 30, 1978

[30] Foreign Application Priority Data

Jan. 30, 1978 [DE] Fed. Rep. of Germany ..... 2803853

[51] Int. Cl.[3] ..... F04C 9/00; F01C 9/00

[52] U.S. Cl. ..... 417/481; 92/120; 91/339; 123/18 R

[58] Field of Search ..... 417/481, 482, 483, 484; 91/339; 92/120, 121, 125; 123/18 R

[56] References Cited

U.S. PATENT DOCUMENTS

| | | | |
|---|---|---|---|
| 1,467,619 | 9/1923 | Hull | 417/481 |
| 2,008,243 | 7/1935 | Coletta | 92/125 |
| 2,436,854 | 3/1948 | Corey | 417/490 |
| 2,864,316 | 12/1958 | Verrue | 417/482 |
| 3,707,073 | 12/1972 | Bernstein | 123/18 R |

FOREIGN PATENT DOCUMENTS

| | | | |
|---|---|---|---|
| 2329933 | 1/1975 | Fed. Rep. of Germany | 92/121 |
| 2613472 | 10/1977 | Fed. Rep. of Germany | 417/481 |

*Primary Examiner*—Carlton R. Croyle
*Assistant Examiner*—Rae Evans Cronmiller
*Attorney, Agent, or Firm*—R. S. Visk; R. W. McIntire, Jr.

[57] ABSTRACT

A pivotal piston machine or compressor including a disc-like pivotal piston oscillating on a bearing axis, such oscillatory movement being effected by engagement of a roller-type cam follower of a crank arm driven by a crankshaft, with cam surfaces formed on the pivotal piston, and angled member for limiting the oscillating movement at opposite ends of the pivotal stroke of the piston. The angled member serves as a separating wall between two compression chambers and a delivery chamber. A pair of pivotal pistons may be arranged adjacent each other to utilize a common air intake and provide a compound piston machine.

2 Claims, 6 Drawing Figures

PIVOTAL PISTON MACHINE

BACKGROUND OF THE INVENTION

Some of the presently known pivotal piston compressors are objectionable for various reasons. For example, one such pivotal piston compressor is characterized by a pivotal piston supported on a piston shaft and oscillating in a cylindrical housing. The housing is provided with at least one radially disposed partition to form a limit for the compression space. In this form, an effective sealing arrangement between the pivotal piston and the cylindrical housing walls is not possible, especially adjacent the end walls, so that compressed air can leak past the seals from the compresson chamber back into the intake chamber. Such leakage results in inefficiency and high or uncontrollable operating temperatures.

Another type of pivotal piston compressor is characterized by a spherical housing in which a circular or disc-type pivotal piston is employed. Since a continuous sealing element may be disposed on the circumference of the disc, leakage between the compression chamber and the intake chamber is thus reduced. The spherical housing, however, is divided at its greatest diameter into two sections thereby forming a juncture seam. This construction requires a more costly two-part piston to prevent passing over the seam, because a one-part piston would have to pass over the seam when oscillating, thereby causing rapid wear or destruction of the sealing element.

Moreover, in the above-described types of pivotal piston compressors, it is not feasible to mount driving means within the housing, and, therefore, driving means must be placed outside the housing which is a more costly arrangement.

SUMMARY OF THE INVENTION

The object of the present invention, therefore, is to provide a pivotal piston compressor utilizing a housing having a seamless spherical interior in which a pivotal piston is operably disposed with driving means therefor also disposed within the interior limits of said housing.

Briefly, the pivotal piston compressor embracing the invention comprises a housing having a spherically shaped interior chamber in which a disc-like pivotal piston is disposed for oscillatory motion. A wedge-shaped wall or valve plate member extends into the spherical chamber and cooperates with a casing cover plate to form a pressure delivery chamber on one side of said wall and cooperates with the pivotal piston to form two compression chambers on the opposite side of said wall, the radial portions of said angled wall acting as limit stops for the oscillatory movement of the pivotal piston will the apex of the wedge acting as the bearing for the pivotal axis of the piston. Oscillatory motion is imparted to the pivotal piston by a crankshaft driving a crank arm having a roller on the end thereof engaging an appropriately contoured cylindrical cam surface formed on the periphery of the disc-like impeller for imparting said oscillatory motion thereto. Other driving arrangements such as a camshaft with cams engaging a cam surface of the pivotal piston, or a crankshaft with a connecting rod eccentrically connected to the pivotal piston may be employed.

DESCRIPTION AND OPERATION

Figure 1:
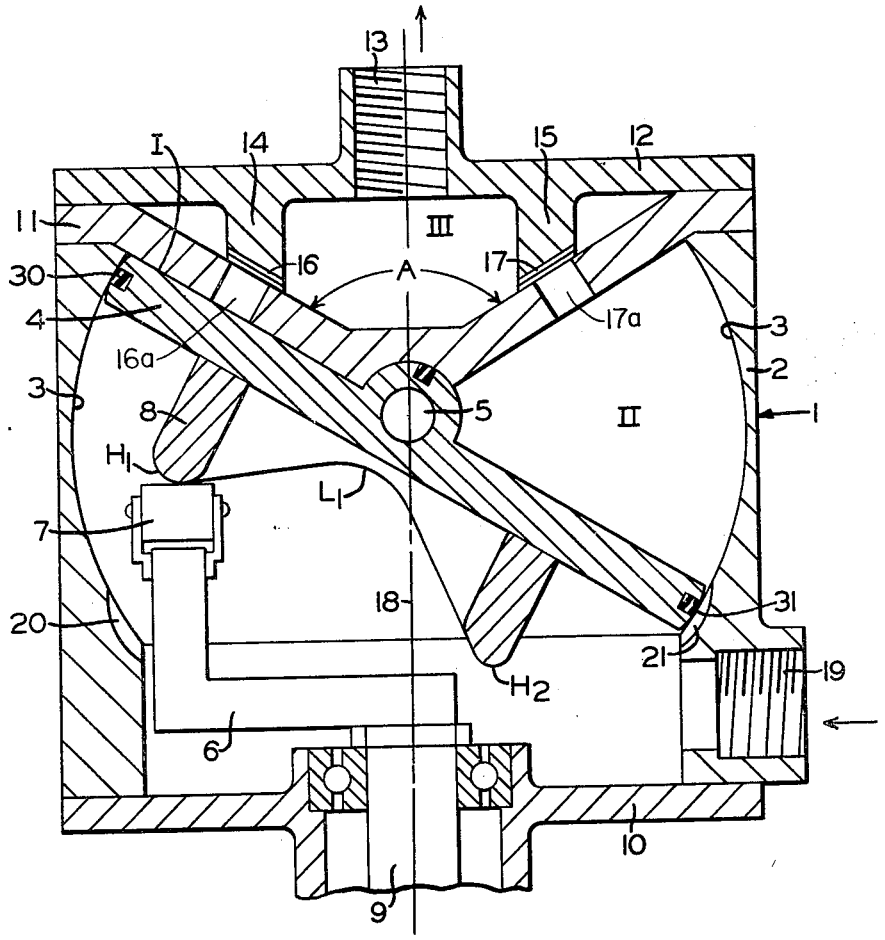
FIG. 1 is an elevational view, in section, of a spherical-type pivotal piston compressor employing a crank arm and driveshaft drive arrangement.

In accordance with FIG. 1, a pivotal piston compressor 1 comprises a housing having a spherical internal piston chamber 3, the external contour of which housing may be spherical or angular. The internal spherical contour of piston chamber 3 is formed without juncture seams, particularly in the path of oscillation of a disc-shaped oscillating pivotal piston 4. The geometric midpoint axis of the spherical chamber 3 coincides with that of a bearing shaft 5 of the pivotal piston 4. End bearings (not shown) for the pivotal piston bearing shaft 5 are disposed within the housing 2 or in the pivotal piston 4.

Adjacent one side of pivotal piston 4 is a crank arm 6 having at a free end thereof a roller or cam follower 7 which is in rolling contact with a cylindrical cam 8 formed on and extending coaxially from the adjacent side of the pivotal piston 4. Rotary movement of crank arm 6 is effected by a driveshaft 9 concentrically supported in an end wall 10 of housing 2.

On the side of the pivotal piston 4 opposite crank arm 6 is located a wedge-shaped valve plate 11 having a V-shaped cross section and clamped between the cylinder housing 2 and a cover 12 fitted with an outlet or delivery connection 13. The sides of V-shaped plate 11 form an inner obtuse angle A. The cover 12 has a pair of parallel ribs 14 and 15 extending axially downwardly therefrom and terminating short of the respective sloping upper sides of V-shaped plate 11 so as to leave respective spaces therebetween in which respective disc-type discharge valves 16 and 17 are operably disposed. Though the specific details are not shown, disc valves 16 and 17 have limited axial movement and are constrained from lateral displacement. Disc valves 16 and 17 operate in conventional manner in controlling discharge from compression chambers I and II into a delivery chamber III defined by cover 12, valve plate 11, and between ribs, via openings 16a and 17a, respectively, formed in said valve plate. Compression chambers I and II are defined by the radial portions of the pivotal piston 4 lying on either side of a central axis 18, the spherical walls of piston chamber 3, and the lower side of valve plate 11.

Between the cover 12 and valve plate 11 and within the inner angle A, is situated the common pressure or delivery chamber III opening to the outlet connection 13. A connection to compression chambers I and II is provided by a common housing inlet port 19 and a scavenging port 20 in pressure chamber I and a scavenging port 21 is pressure chamber II. In place of the ports 20 and 21, conventional intake valves (not shown) may be installed.

In operation of the pivotal piston compressor 1, atmospheric air flows via inlet port 19 into the crankshaft housing, and via scavenging port 20 or 21 reaches the particular compression chamber I or II in which the pivotal piston 4, at that moment, is just at the bottom dead center. The compressed air that is produced by pivoting or piston 4 from the bottom to the top dead center, which is caused by the operative connection between driveshaft 9, crank arm 6, and cam 8, say, for example, in compression chamber I, passes through opening 16*a* to cause the corresponding discharge valve 16 to be unseated off said opening and thereby allow compressed air to flow into delivery chamber III and from there to a user device (not shown) via connection 13. Valve 17 is held down on opening 17*a* by suction created in chamber II by action of piston 4. Oscillating motion of pivotal piston 4 is provided by rolling of roller 7 over an undulated cam surface of cam 8 having two diametrically opposite high points $H_1$ and $H_2$ disposed at 90° relative to two diametrically opposite low points $L_1$ and $L_2$, only one of said low points being shown in FIG. 1.

Figure 2:
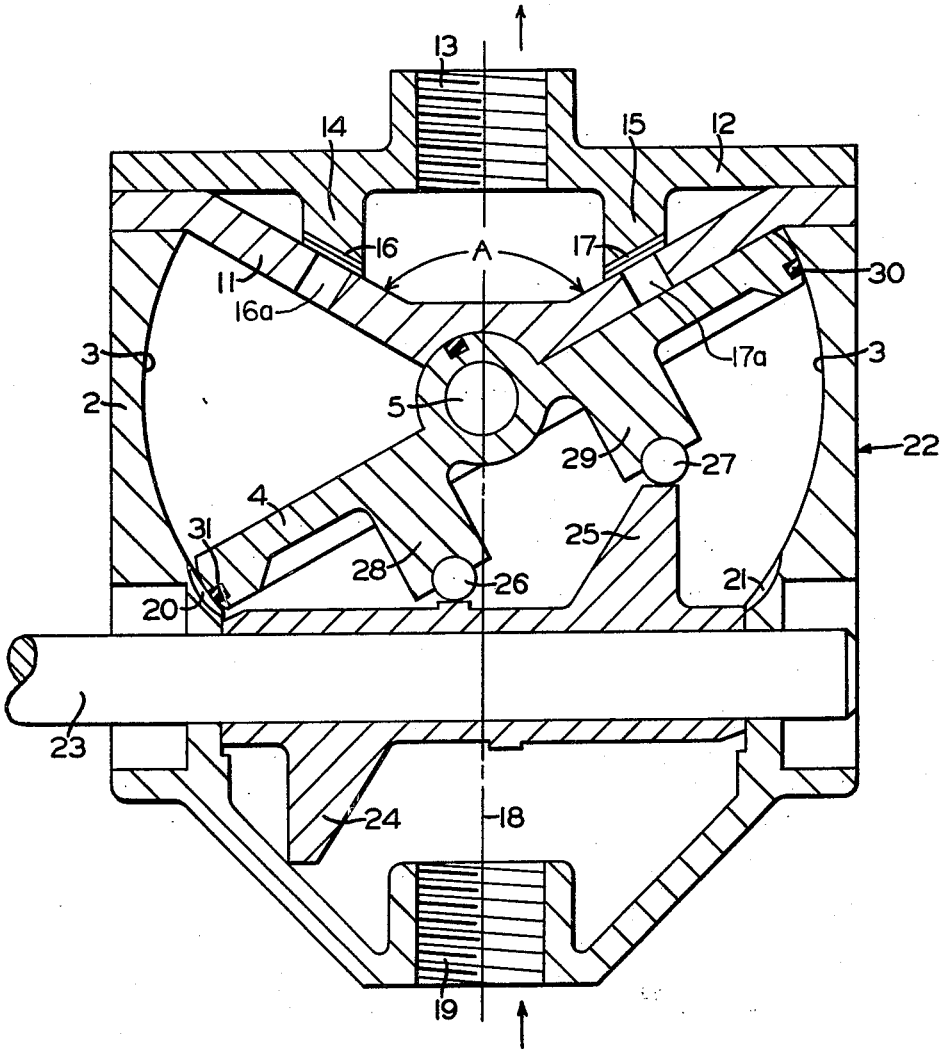
FIG. 2 is an elevational view, in section, of a spherical-type pivotal piston compressor employing a cam and camshaft drive arrangement.

The basic design of a pivotal piston compressor 22 shown in FIG. 2 is generally similar to that shown in FIG. 1, except that the drive means comprises a camshaft 23 rotatably supported supported in housing 2. Camshaft 23 carries a pair of axially-spaced helical cams 24 and 25. The peripheral contours of which make rolling contact with a pair of rollers 26 and 27 carried at the extremities or free ends of a pair of diametrically oppositely disposed cam pins 28 and 29, extending axially from the bottom side of pivotal piston 4. Cams 24 and 25 are formed and arranged on camshaft 23 such that the respective high points of said cams are disposed on diametrically opposite sides of said camshaft. Thus, rotation of camshaft 23 causes cams 24 and 25, which engage rollers 26 and 27 on cam pins 28 and 29, respectively, to impart rocking or oscillating motion to pivotal piston 4 for effecting compressing action.

The pivotal piston herein described and shown in the form of a compressor, as an example, with further refinement and the same chamber arrangement could be designed as an internal combustion engine, in which case an annular sealing ring 30 carried in a groove 31 surrounding the periphery of piston 4 could be a metal-type ring.

Figure 3:
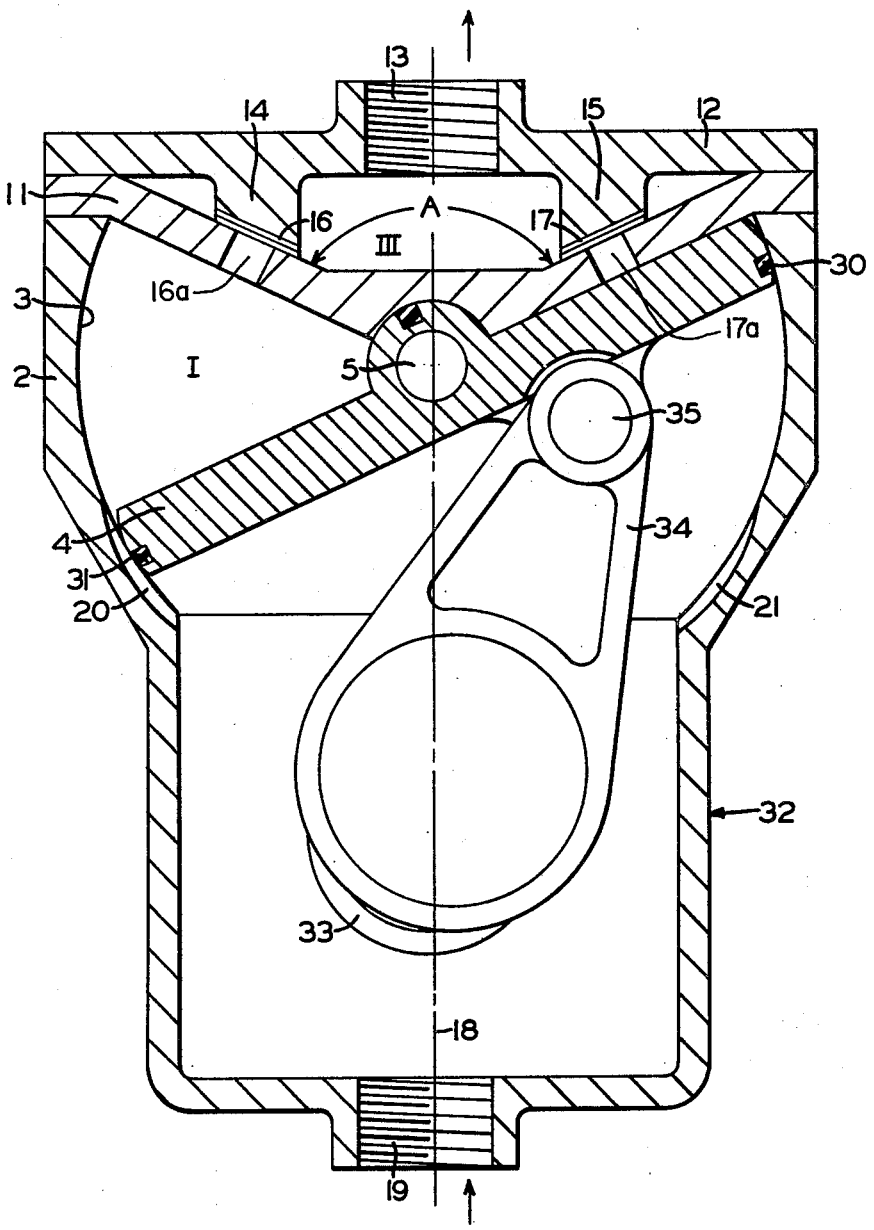
FIG. 3 is an elevational view, in section, of a spherical-type pivotal piston compressor employing a crankshaft and connecting rod drive arrangement.

A pivotal piston compressor 32 shown in FIG. 3 is essentially similar to compressors 1 and 22 shown in FIGS. 1 and 2, respectively, except that driveshaft 9 of FIG. 1 and camshaft 23 is replaced by a driving crankshaft 33 on an eccentric portion of which one end of a connecting rod 34 is pivotally connected, the other end of said connecting rod being pivotally connected to a crank pin 35 secured to the bottom side of pivotal piston 4 and offset to one side of the bearing shaft 5. Rotation of crankshaft 33 causes reciprocating motion of connecting rod 34, which, in turn, produces oscillating motion of piston 4 and consequent compressing action.

Figure 4:
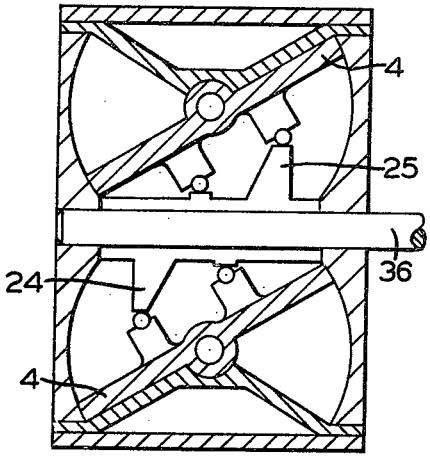
FIG. 4 is an elevational view, in section and on a smaller scale than FIGS. 1 through 4, of an opposed piston or compound spherical-type pivotal piston compressor employing the cam and camshaft drive arrangement similar to that shown in FIG. 2.
Figure 5:
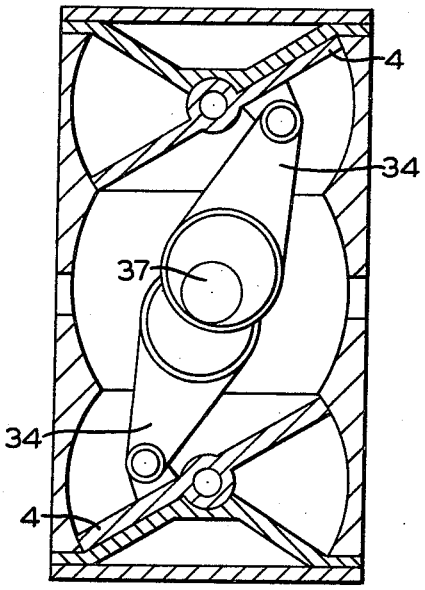
FIG. 5 is an elevational view, in section and on the same scale as FIG. 4, of an opposed piston or compound spherical-type pivotal piston compressor employing the crankshaft and connecting rod drive arrangement similar to that shown in FIG. 3.

As shown in FIGS. 4 and 5, it is possible to provide a compound compressor unit by connecting a pair or a series of pairs of pivotal piston compressors of the types shown in FIGS. 1 and 2 in which a common camshaft 36 and a common driveshaft 37 is operably interconnected between each pair of compressors.

Figure 6:
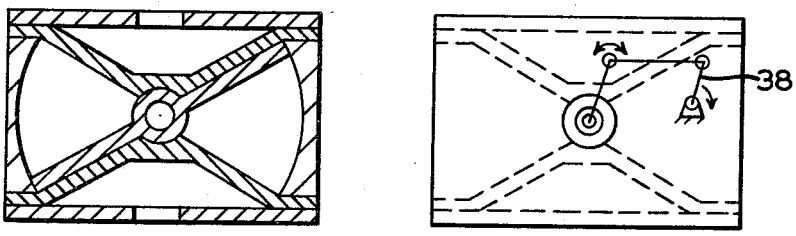
FIG. 6 is an elevational view, in section and on the same scale as FIG. 4, of a four-chamber or compound spherical-type pivotal piston compressor employing externally disposed drive means.

It is also possible to provide a four-chamber pivotal piston compressor, as shown in FIG. 6, wherein driving means 38 must be located outside the housing limits.

Certain details such as inlet and outlet ports 19 and 13, scavenging ports 20 and 21, discharge valves 11-16 and 11-17, etc. are omitted from the view shown in FIGS. 4, 5, and 6, since said views are primarily diagrammatic views illustrating the possible variations of compressors.

Having now described the invention, what I claim as new and desire to secure by Letters Patent, is:

1. A pivotal piston compressor comprising:
(a) a housing having a spherical piston chamber characterized by a continuous seamless surface, an outlet port, and an inlet port formed therein;
(b) a disc-shaped pivotal piston oscillatingly disposed in said piston chamber on an oscillatory axis coinciding with the greatest diameter of said spherical piston chamber;
(c) an annular sealing ring disposed in an annular groove surrounding the periphery of said piston;
(d) a valve plate in the form of a wedge and of V-shaped cross section and disposed in said piston chamber with the apex of the wedge coinciding with said oscillatory axis and serving as an oscillatory pivotal bearing for the pivotal piston,
(e) said valve plate cooperating with said housing to form on one side and within the inner angle thereof a delivery chamber communicating with said outlet port, and cooperating with said housing and pivotal piston to form on the side opposite said one side a pair of compression chambers communicable with said delivery chamber via respective discharge valves disposed in said valve plate;
(f) each of said compression chambers communicating with said inlet port via respective scavenging ports formed in the inner wall of said housing, and each of said compression chambers being alternately pressurized via said scavenging ports and discharged via said discharge valves by oscillating motion of said piston;
(g) a cylindrical cam extending coaxially from the side of said pivotal piston opposite the compression chambers, said cam having an undulated cam surface characterized by two diametrically opposite high points disposed at 90° relative to two diametrically opposite low points,
(h) a crank arm having a cam roller for making rolling contact with said cam surface; and
(i) a driveshaft for rotating said crank arm for imparting oscillating motion to said pivotal piston.

2. A pivotal piston compressor comprising:
(a) a housing having a spherical piston chamber characterized by a continuous seamless surface, an outlet port, and an inlet port formed therein;
(b) a disc-shaped pivotal piston oscillatingly disposed in said piston chamber on an oscillatory axis coinciding with the greatest diameter of said spherical piston chamber;
(c) an annular sealing ring disposed in an annular groove surrounding the periphery of said piston;

(d) a valve plate in the form of a wedge and of V-shaped cross section and disposed in said piston chamber with the apex of the wedge coinciding with said oscillatory axis and serving as an oscillatory pivotal bearing for the pivotal piston, (e) said valve plate cooperating with said housing to form on one side and within the inner angle thereof a delivery chamber communicating with said outlet port, and cooperating with said housing and pivotal piston to form on the side opposite said one side a pair of compression chambers communicable with said delivery chamber via respective discharge valves disposed in said valve plate;

(f) each of said compression chambers communicating with said inlet port via respective scavenging ports formed in the inner wall of said housing, and each of said compression chambers being alternately pressurized via said scavenging ports and discharged via said discharge valves by oscillating motion of said piston, (g) said pivotal piston being provided with a pair of diametrically disposed cam pins extending axially from the side of said pivotal piston opposite the compression chambers, each of said cam pins having a cam roller on the free end thereof; and (h) a camshaft having a pair of axially spaced helical cams for making rolling contact with said cam rollers, respectively, (i) the respective high points of said cams being disposed on diametrically opposite sides of said camshaft so as to impart oscillating motion to said pivotal piston upon rotation of the camshaft.

* * * * *